US006346299B1

(12) United States Patent
Gruszczynski, II et al.

(10) Patent No.: US 6,346,299 B1
(45) Date of Patent: Feb. 12, 2002

(54) METHOD AND APPARATUS FOR IMPROVING THE UNIFORMITY OF A LIQUID CURTAIN IN A CURTAIN COATING SYSTEM-CURTAIN FORMATION/ CORRECTION

(75) Inventors: David W. Gruszczynski, II, Webster; Kenneth J. Ruschak, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/660,141

(22) Filed: Sep. 13, 2000

(51) Int. Cl.[7] ..... B05D 1/18; B05C 11/11

(52) U.S. Cl. ..... 427/430.1; 427/420; 427/444; 118/429; 118/324; 118/DIG. 4

(58) Field of Search ..... 118/324, DIG. 4, 118/429; 427/420, 430.1, 444

(56) References Cited

U.S. PATENT DOCUMENTS

| | | | | |
|---|---|---|---|---|
| 3,404,025 A | | 10/1968 | Wootten | |
| 3,632,374 A | | 1/1972 | Greiller | |
| 3,867,901 A | | 2/1975 | Greiller | |
| 4,109,611 A | * | 8/1978 | Fahrni et al. | 118/325 |
| 4,510,882 A | | 4/1985 | Prato | |
| 4,851,268 A | | 7/1989 | Kozak | |
| 4,922,851 A | | 5/1990 | Morikawa et al. | |
| 5,017,408 A | | 5/1991 | Kozak | |
| 5,105,758 A | | 4/1992 | Kozak | |
| 5,136,970 A | | 8/1992 | Saito et al. | |
| 5,338,359 A | | 8/1994 | Conroy et al. | |
| 5,413,818 A | | 5/1995 | Suga et al. | |
| 5,462,598 A | * | 10/1995 | Servant et al. | 118/324 |
| 5,725,666 A | | 3/1998 | Baumlin | 118/324 |
| 5,759,633 A | | 6/1998 | Baumlin et al. | |
| 5,773,093 A | | 6/1998 | Mitani et al. | |
| 5,885,659 A | | 3/1999 | Takahashi et al. | |
| 6,117,236 A | * | 9/2000 | Ruschak et al. | 118/300 |

FOREIGN PATENT DOCUMENTS

EP 0 107 818 A2 11/1983

* cited by examiner

*Primary Examiner*—Katherine A. Bareford
(74) *Attorney, Agent, or Firm*—Mark G. Bocchetti

(57) ABSTRACT

A movable trough is taught for establishing a uniform wetting line on the rear face of a curtain coating hopper lip. The trough can be pivoted or moved linearly into a position such that the hopper lip resides in or proximate to the movable trough. The curtain coating apparatus is then started and the coating solution leaving the hopper lip is intercepted by the trough. The coating solution flowing over the lip fills and floods the movable trough. The flooding of the trough forces the coating solution to substantially wet (to a height on the back side of the lip significantly higher than that of natural product flow) the back side of the hopper lip. The movable trough is then retracted from its position immediately beneath the hopper lip and intercepting the coating solution exiting the hopper lip to thereby allow the free-falling curtain to form and begin impingement on the moving support web to be coated. As the curtain forms, the wetting line on the back of the hopper lip naturally retracts toward the tip of the hopper lip thereby forming a uniform wetting line and a uniform curtain.

15 Claims, 11 Drawing Sheets

METHOD AND APPARATUS FOR IMPROVING THE UNIFORMITY OF A LIQUID CURTAIN IN A CURTAIN COATING SYSTEM-CURTAIN FORMATION/ CORRECTION

FIELD OF THE INVENTION

The present invention relates generally to the field of curtain coating and, more particularly, to methods and apparatus for establishing a uniform wetting line on the back surface of a curtain coating hopper lip.

BACKGROUND OF THE INVENTION

The technique of curtain coating is widely used in the industry of manufacturing photographic films and papers. Typically, a curtain coating apparatus comprises a feed system in the form of one or more slots fed with photographic emulsions and from which the photographic emulsions flow in the form of one or more layers which are superimposed on a slightly inclined plane. The photographic layers then flow onto a lip, where they leave the coating device to form a liquid curtain in substantially vertical free fall. The free-falling curtain is deposited on a moving support web typically while the web is supported on a driven roller. Structurally, the lip is substantially vertical and has a front face on which the layers of photographic emulsion flow, and a rear face forming, with respect to the front face, an angle which is typically around 30° to 45°. The bottom edge of the front face and the bottom edge of the rear face are separated by a bevel, the width of which varies overall between 0.1 mm and 2.5 mm. For applications of this type, the flow rates (per unit width of the lip) vary from 0.6 $cm^2/s$ to 6 $cm^2/s$. The viscosity of the photographic layers varies from 0.005 to 3 poise. All these quantities are, of course, mentioned only by way of reference.

Such curtain coating systems have been the subject of numerous patents. By way of example, reference can be made to the European Patent No. EP-A-107 818; U.S. Pat. No. 4,510,882, U.S. Pat. No. 3,632,374; U.S. Pat. No. 3,867,901; and French Patent No. FR-A-2 346 057.

One condition that a curtain coating system can be particularly sensitive to (notably for photographic applications for which uniformity of coating is essential) is the formation of a curtain that is not uniform and homogeneous. This is because a non-uniform curtain creates streaks on the photographic product. That is, the coating is applied to the support web with variations in thickness across the width of the support web. These variations have an appreciable effect on the photographic properties of the film and consequently it is important to minimize such variations.

U.S. Pat. No. 5,725,666 to Baumlin, entitled "Method and Apparatus for Improving the Uniformity of a Liquid Curtain in a Curtain Coating System," teaches a tool for creating a uniform wetting line on the rear face of the lip of a curtain coater. A perspective view of the tool is shown in FIG. 1. The device comprises two fingers 1, 2 mounted on a frame 3. Each of the fingers 1, 2 defines a first surface 4, 5 designed to be brought to bear on the front face of the lip of the coating device, and a second or rear surface 6, 7 designed to be applied substantially to the rear face of the lip. The first surface forms, with respect to the second surface, an angle substantially equal to the angle formed by the front and rear faces of the lip. Generally, the angle between the two surfaces varies from 30° to 45°. The height of the rear surface 6, 7 of each of the fingers is at least equal to the height over which it is intended that the liquid should wet the rear face of the lip.

During operation, an operator applies the wetting device to the lip of the coating device and slides it so as to cause it to travel at least once over substantially the whole width of the lip. Thus, the rear surface 6, 7 of each of the fingers is applied opposite the rear face of the lip and forces the liquid to wet the rear face of the lip over a height greater than its natural wetting height. There are some problems associated with the use of the device taught by Baumlin. Operator intervention is required. Operation of the tool is manually intensive. Operation of the tool results in generating substantial liquid waste at startup.

U.S. Pat. No. 5,759,633 to Baumlin et al. and entitled "Method for Improving the Uniformity of a Liquid Curtain in a Curtain Coating System," teaches a method for improving curtain uniformity by forming a liquid curtain over the front face of a lip, progressively reducing the flow rate over the lip to a set value for a period of time so that the rear face of the lip is wet to a greater height, and increasing the flow rate to defined coating conditions. According to the teachings of Baumlin et al., there is initially a liquid composition with a high flow rate (6 $cm^2/s$) and a low viscosity ($6.5\times10^{-3}$P, which typically corresponds to water at 40° C. to which surfactants are added to facilitate the formation of the curtain). The flow rate is reduced (1.5 to 2 $cm^2/s$) so as to attain the flow rate level of a wettability window defining a flow rate and viscosity region within which the liquid composition wets the rear face of the lip over a height greater than the natural wetting height over which the coating composition would wet under the operating coating conditions ($50\times10^{-2}$P at a flow rate of 4 $cm^2/s$). There is a progressive change from water to the photographic composition, while the flow rate is held substantially at the reduced value. The change from water to the photographic composition results in an increase in viscosity, which takes place progressively so that the process stays within the wettability window for a sufficiently long period (generally longer than 1second). The viscosity of the coating composition continues to increase outside the conditions of the wettability window. The flow rate is then increased to attain the coating rate. The wetting of the rear face of the lip remains uniform and has an average height of around 0.1 mm.

The location and size of the wettability window are, to a large extent, dependent on the geometry of the lip. Baumlin et al. teaches that for each type of lip there is a corresponding wettability window.

There are some drawbacks associated with the method taught by Baumlin et al. First, the method requires that water precede the introduction of product solutions on the slide surface of the curtain coating apparatus. Further, it is difficult to control the flow rates of the various coating layers in conjunction with the viscosity. The method relies on establishment of the wetting line to substantially wet the back of the lip uniformly across the entire width of the lip. There is also the dependence of the wettability windows on lip geometry requiring that a wettability window be established for each coating lip of different geometry.

Baumlin et al. also teaches a second embodiment of the method. According to this embodiment, a solution of gelatin and surfactant having a viscosity of 0.03P is used. Initially, the curtain is established with a high flow rate (around 6 $cm^2/s$). The rate is then reduced to about 1.5 $cm^2/s$, producing a significant wetting of the rear face of the lip. These conditions are maintained for a few seconds, and the flow rate is again increased to 6 $cm^2/s$. This embodiment of Baumlin et al. has drawbacks similar to those discussed above.

SUMMARY OF THE INVENTION

It is therefore an object of the present invention to provide a method and apparatus for generating a uniform wetting line on the rear face of a curtain coating hopper lip.

It is a further object of the present invention to provide a method and apparatus for generating a uniform wetting line on the rear face of a curtain coating hopper lip which is not dependent on wettability windows and hopper lip geometry.

Yet another object of the present invention is to provide method and apparatus for generating a uniform wetting line on the rear face of a curtain coating hopper lip which can be automatically actuated and minimizes waste.

Still another object of the present invention is to provide a method and apparatus for generating a uniform wetting line on the rear surface of a curtain coating hopper lip which does not require physical contact between the apparatus and the hopper lip.

Briefly stated, the foregoing and numerous other features, objects and advantages will become readily apparent upon a review of the detailed description, claims and drawings set forth herein. These features, objects and advantages are accomplished by using a movable trough positioned in close proximity to the hopper lip. The movable trough can be pivoted or moved linearly into a position such that the hopper lip resides proximate to the movable trough. The curtain coating apparatus is then started and the coating solution leaving the hopper lip is intercepted by the trough. The coating solution flowing over the lip fills and floods the movable trough. The flooding of the trough forces the coating solution to substantially wet (to a height on the back side of the lip significantly higher than that of natural product flow) the back side of the hopper lip. The movable trough is then retracted from its position immediately beneath the hopper lip and intercepting the coating solution exiting the hopper lip to thereby allow the free-falling curtain to form and begin impingement on the moving support web to be coated. As the curtain forms, the wetting line on the back of the hopper lip naturally retracts toward the tip of the hopper lip thereby forming a uniform wetting line and a uniform curtain.

DETAILED DESCRIPTION OF THE INVENTION

Figure 1:
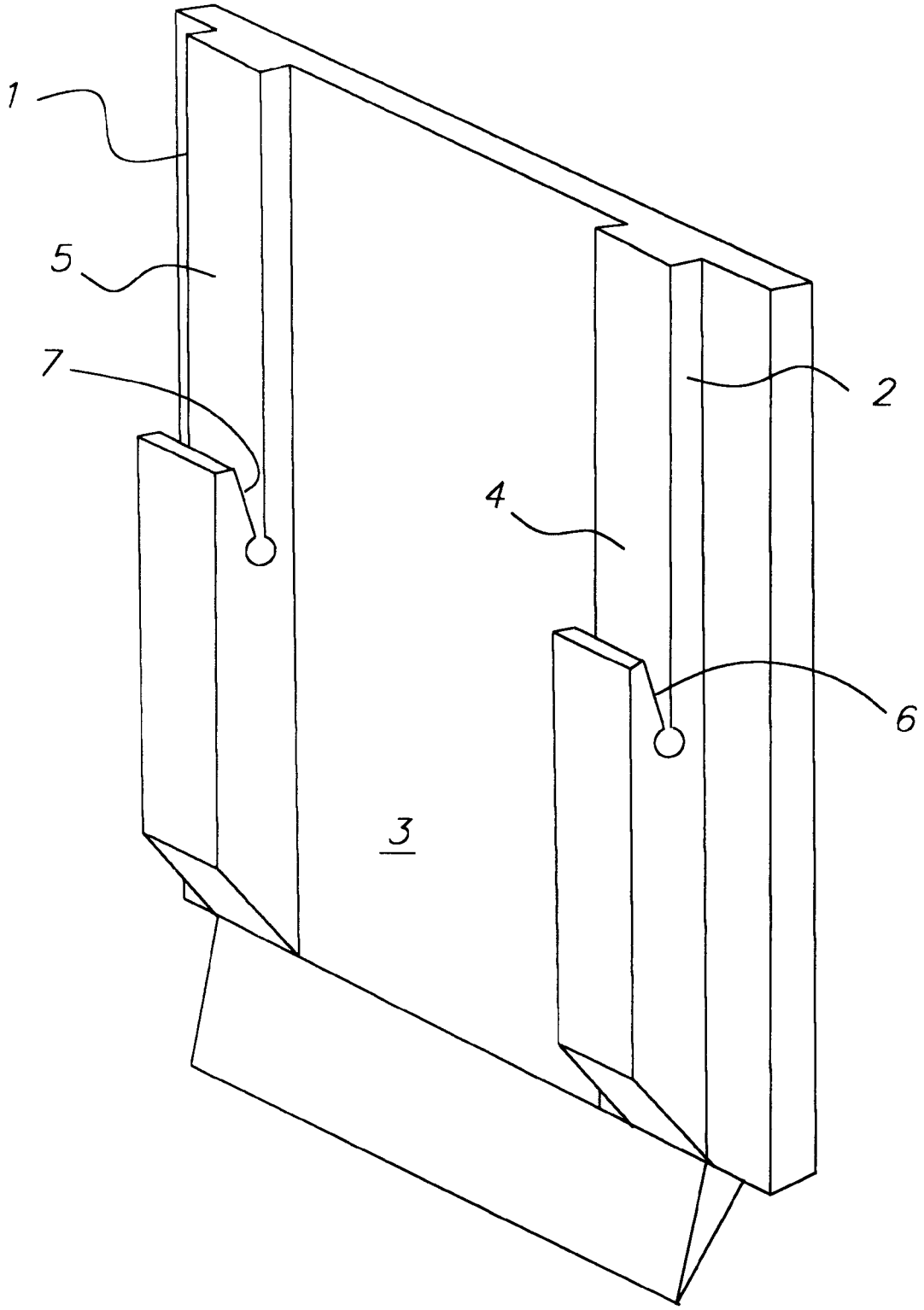
FIG. 1 is a perspective view of a prior art device used to achieve a uniform wetting line on the rear surface of a hopper lip of a curtain coating apparatus.
Figure 2:
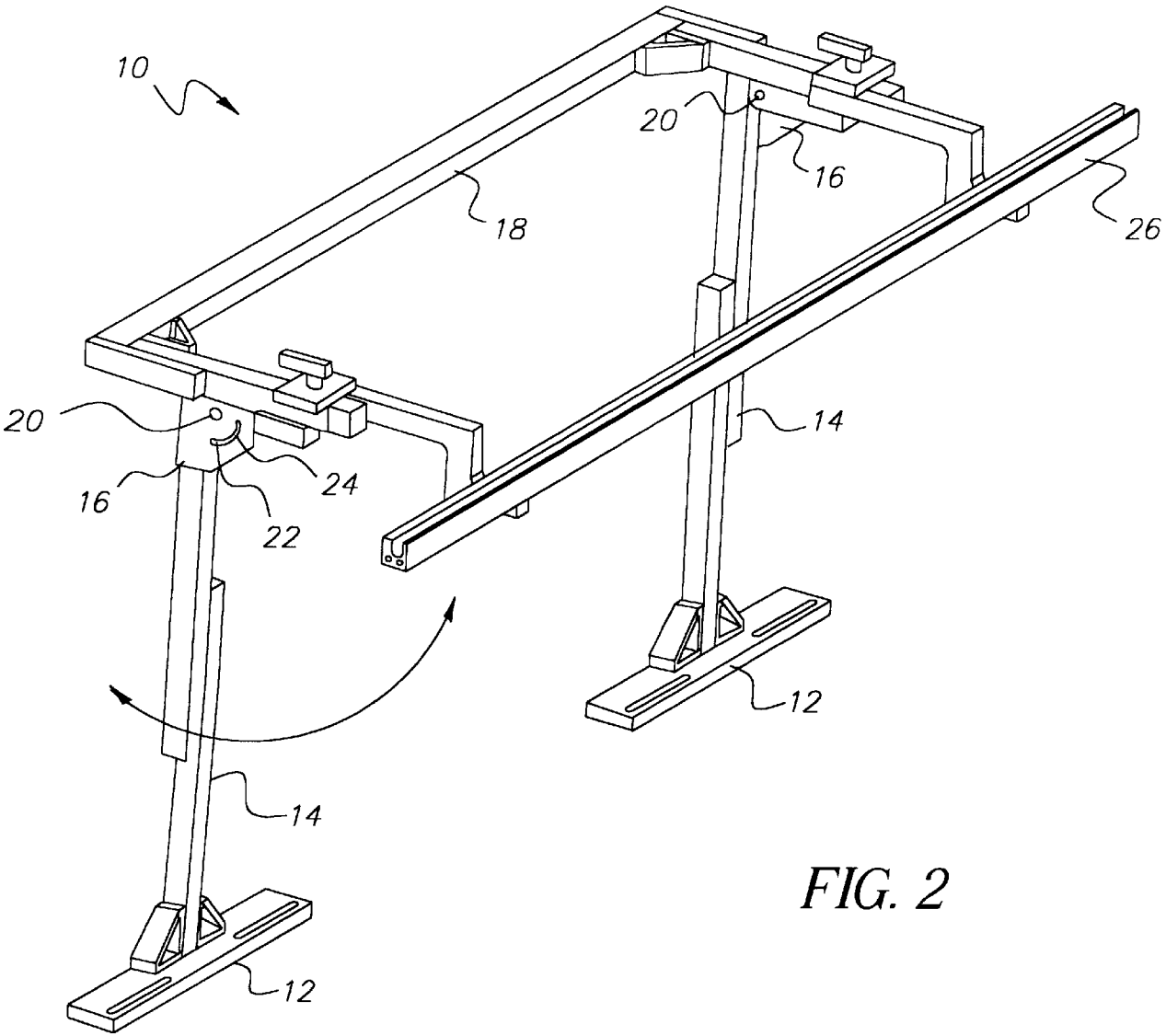
FIG. 2 is a perspective view of a movable trough apparatus of the present invention which can be manually positioned to intercept the coating solution exiting the hopper lip of a curtain coating apparatus, such that the hopper lip is flooded to establish a uniform wetting line on the rear surface of the hopper lip.

Turning to FIG. 2, there is shown a perspective view of a movable trough system 10 adapted to be used in conjunction with a coating hopper (not shown). The system 10 includes feet 12 adapted to be affixed to the floor of a coating room. Extending up from feet 12 are adjustable legs 14. Affixed to the top of legs 14 are gussets 16. There is a frame 18 pivotally attached to gussets 16 by means of pins 20. An arcuate slot 22 in one or both gussets 16, in conjunction with pins 24 extending from frame 18 into a respective arcuate slot 22, serve as travel stops, limiting the amount of travel that frame 18 can be pivoted. Affixed to frame 18 is trough 26. Through the pivoting movement of frame 18, trough 26 can be positioned in close proximity to the curtain coating hopper lip Such that the hopper lip resides in or proximate to trough 26. Positioning of trough 26 can be performed manually by an operator, or can be powered such as through the use of a stepper motor. In either case, it is preferred that the trough position be governed by hard stops to insure that there will be no physical contact between the trough 26 and the coating lip. If positioning of trough 26 is performed manually, then the trough 26 will have to be held in position manually for a short period of time while the channel floods and a uniform wetting line is established. Alternatively, a position locking mechanism can be used (such as substituting threaded bolts and nuts for pins 24 so that the position of trough 26 can be positioned by tightening the nuts on the bolts) to hold the trough 26 in position while the channel floods and the uniform order line is established.

Figure 3:
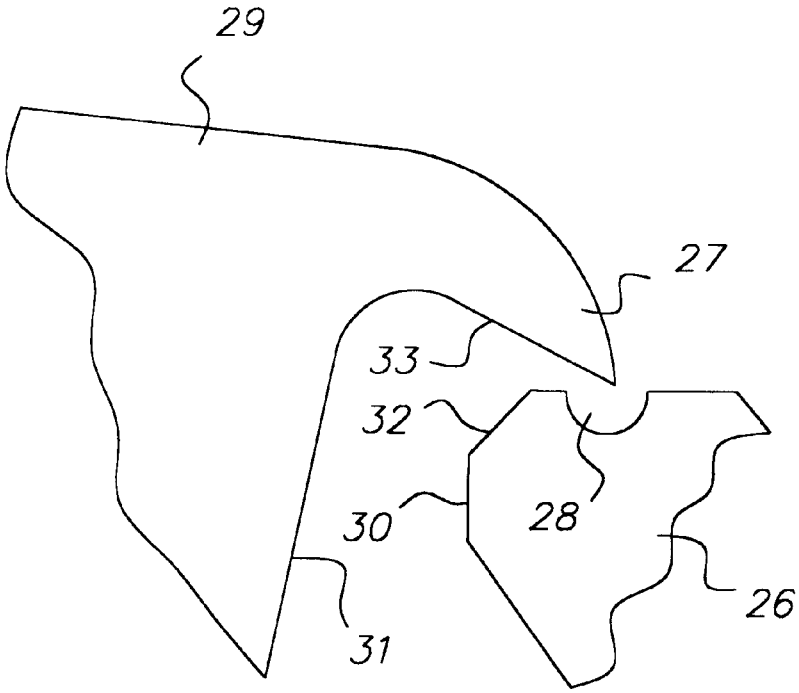
FIG. 3 is a side elevational schematic showing the position of the movable trough of the present invention in close proximity to the lip of a curtain coating hopper to thereby cause the lip to flood on the rear face thereof to an elevation higher than the operating wetting line on the rear face.

Looking next at FIG. 3 there is shown a cross-sectional view of trough 26 residing proximate to the lip 27 of a curtain coating hopper 29. Trough 26 includes a channel 28 into which the solution from the hopper lip 27 pours. Preferably, channel 28 is semicircular in cross-section. However, it is believed that a variety of cross-sectional shapes can be employed successfully including V-shaped, square, trapezoidal, rectangular, and arcuate. The rear wall 30 of the trough 26 near the front face 31 of the curtain coating hopper 29 preferably has a beveled surface 32 to reduce the tendency of the coating liquid to splash onto the front face 31 of the hopper 29. Positioning of the trough 26 is critical. The preferred position is such that the lowest point of the tip of the lip 27 is in the same horizontal plane as the top portion of the trough 26. Importantly, the travel stops in combination with the adjustable legs 14 prevent the trough 26 from travelling into and damaging the hopper lip.

The width of the trough 26 is preferably approximately two (2) inches narrower than the coating width. Thus, there should be about one (1) inch of spacing between each end of the trough 26 and the curtain edge guide equipment (not shown) although the spacing between each end of the trough 26 and the curtain edge guide equipment can be as little as 0.1 inches. Trough 26 is preferably open at each end thereof, such that the excess coating solution is able to flow out of the ends of the channel 28. In this way, although channel 28 substantially fills with liquid excess coating solution liquid does not flow over the top surfaces of trough 26 which could result in contamination of the web and backup roller. In addition, the spacing between the ends of trough 26 and the edge guides is sufficient to prevent the edge guides from being contaminated with the coating solution.

Figure 12:
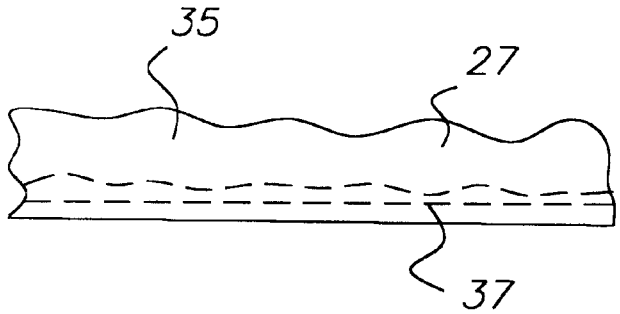
FIG. 12 is a rear elevational view of the coating lip showing the relative elevations of the wetting line thereon when the movable trough of the present invention in close proximity to the lip of a curtain coating hopper to thereby cause the lip to flood and the operating wetting line when the movable trough has been retracted.

The method and apparatus of the present invention is preferably used prophylactically as discussed above. Trough 26 is positioned such that the coating lip 27 resides in or at least proximate to trough 26 prior to the introduction of product solutions to the curtain coating hopper. This can be performed while a pre-product solution fluid (e.g. water) is flowing over the hopper lip, or when no solutions are flowing over the hopper lip 27. If the trough 26 is moved into position while fluid is flowing over the lip 27, then trough 26 should be moved at a relatively slow rate of speed (about 1 inch per sec) in order to prevent the fluid splashing onto the front face 31 of the coating hopper 29. The product solution is introduced into the curtain coating hopper 29 by conventional methods (at coating flow rates or at specific flow rates). Trough 26 is allowed to reside in close proximity to the hopper lip 27 (i.e. breaking the liquid curtain) for approximately 5 seconds. Once product solution flow has been established throughout the entire hopper 29, channel 28 quickly fills, thereby wetting the rear face 33 of the coating lip 27 to an elevation 35 higher than the operating wetting line 37 (see FIG. 12). Trough 26 is then retracted and a uniform operating wetting line 37 is established. Trough retraction rate is preferably relatively quick (on the order of magnitude of 12 inches per second). This can be accomplished by releasing the trough position locking mechanism to thereby allow the trough to fall away in an arcuate path under the force of gravity.

The method and apparatus of the present invention can also be used as a corrective tool if wetting line non-uniformities are observed on the back surface 33 of the coating lip 27. When used as corrective tool, trough 26 begins in the retracted position, that is, not in contact with the liquid curtain (not shown), while the product solution is forming a free-falling curtain. Trough 26 is then moved into a position in close proximity to the coating hopper lip 27 and intercepting the free-falling curtain. The action of placing the trough 26 in close proximity to the hopper lip 27 while product solution is flowing over the lip 27 is performed slowly—at a rate of approximately 1 inch per sec, such that fluid does not splash on the front face 31 of the hopper 29. With the free-falling curtain intercepted by trough 26, channel 28 quickly fills, thereby wetting the rear face 33 of the coating lip 27 to an elevation higher than the operating wetting line. Trough 26 is then retracted and a uniform operating line is established. The trough 26 is allowed to reside in close proximity to the hopper lip 27 (i.e. breaking the liquid curtain) for approximately 5 seconds, then the trough 26 is retracted from its position in close proximity to the lip. Retraction of the trough 26 should again be done quickly such as by releasing trough 26 to allow to fall away in an arcuate path under the force of gravity.

Although the trough 26 depicted in FIG. 2 is described herein as being manually positioned, it should be apparent to those skilled in the art that an automated driving mechanism can be employed to position trough 26 proximate to a coating lip 27. A variety of different rotational and or linear driving mechanisms can be used to position trough 26. Looking next at FIGS. 4 and 5, there is shown an alternative embodiment of the present invention wherein the means for positioning of a trough 40 is through a powered mechanism. Trough 40 is substantially identical to trough 26. A motor 42 having a drive shaft 44 extending therefrom is used to drive the movement of trough 40 in an arcuate path. There are bearings 46 providing rotational support for drive shaft 44. Motor 42 and bearings 46 are supported by a support frame (not shown). Affixed to drive shaft 44 arc arms 48 which support trough 40. Motor 42 drives rotation of drive shaft 44 to cause trough 40 to be moved in an arcuate path either into close proximity with the coating lip 50 of coating hopper 52 to thereby be in position to intercept the free-falling curtain, or away from coating lip 50 such that the freefalling curtain is not intercepted by trough 40. In such manner, trough 40 can be used prophylactically or as a corrective tool as described above with reference to trough 26 to establish a uniform wetting line on the back surface of coating lip 50.

Figure 4:
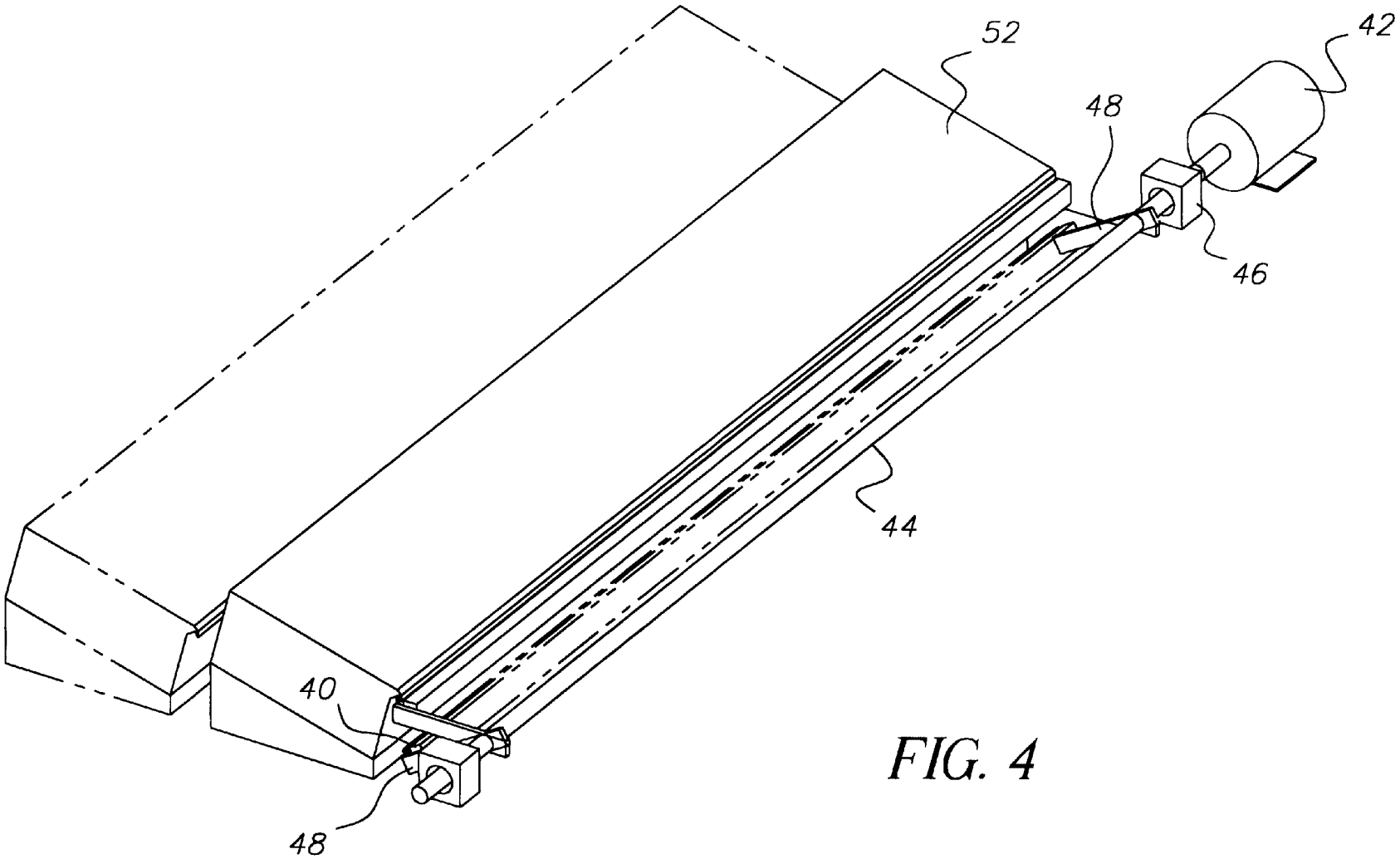
FIG. 4 is a perspective view of the movable trough of the present invention shown in combination with a curtain coating hopper wherein the movable trough is provided with a motorized system for positioning the trough.
Figure 5:
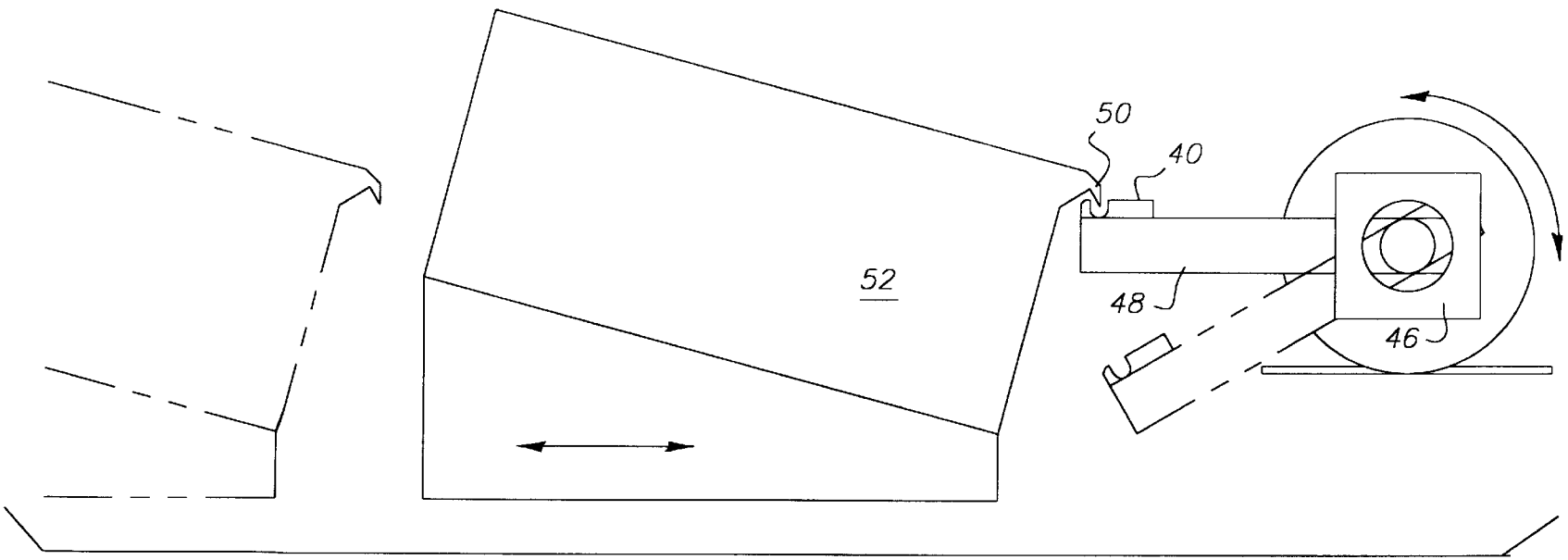
FIG. 5 is a side elevational schematic of the movable trough and system depicted in FIG. 4.
Figure 6:
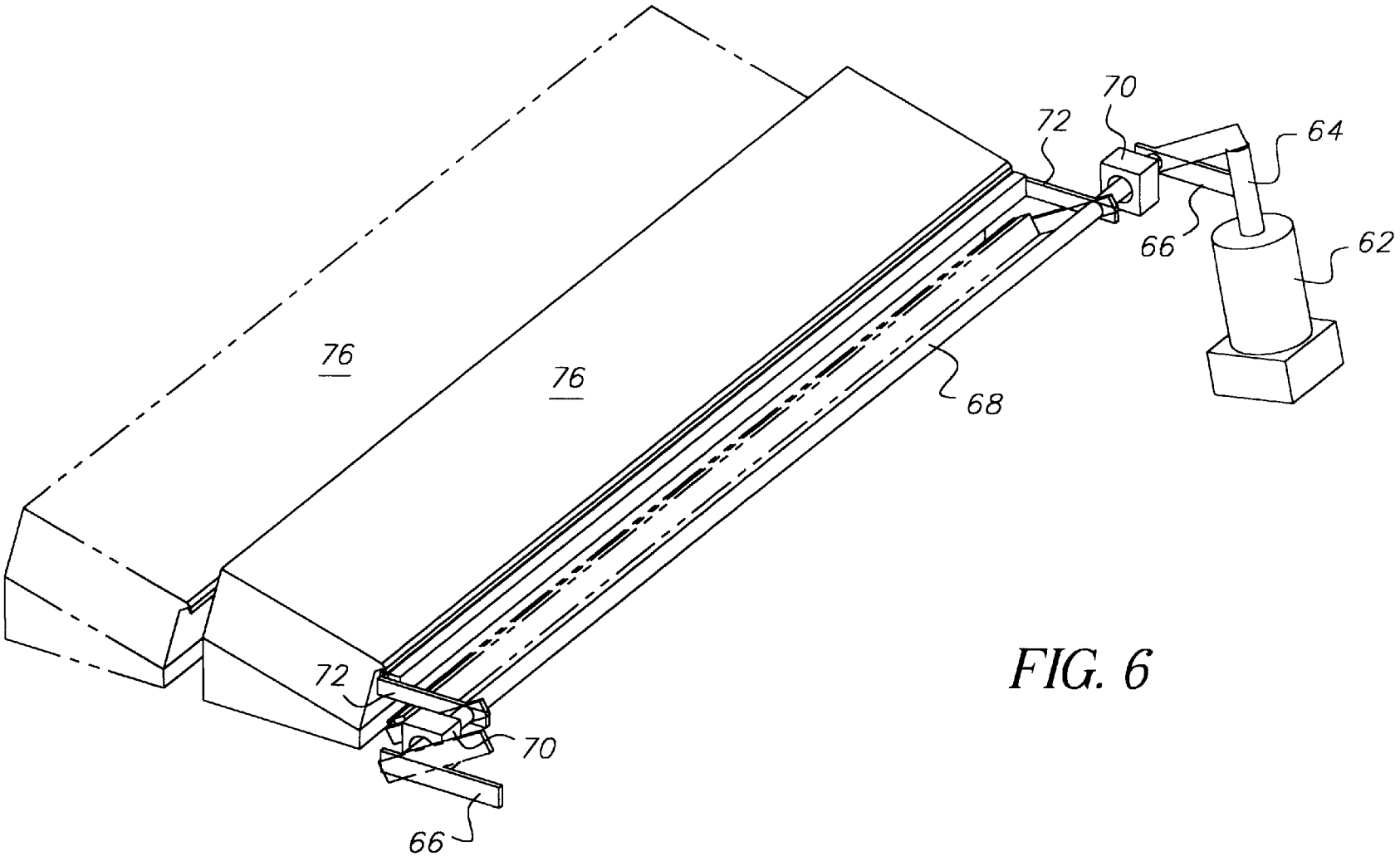
FIG. 6 is a perspective view of the movable trough of the present invention shown in combination with a curtain coating hopper wherein the movable trough is provided with a first alternative automated and powered positioning system from that depicted in FIGS. 4 and 5.
Figure 7:
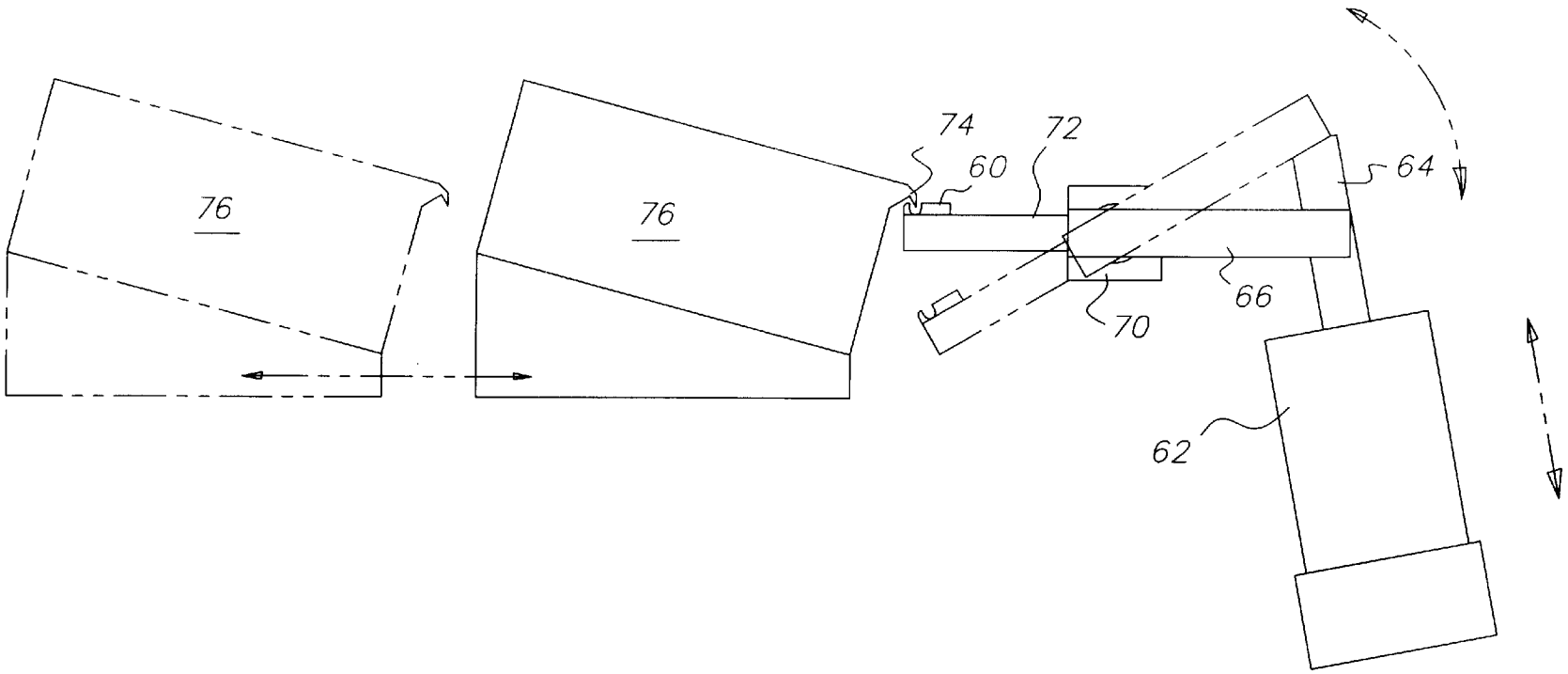
FIG. 7 is a side elevational schematic of the movable trough and system depicted in FIG. 6.

Turning next to FIGS. 6 and 7, there is shown yet another alternative embodiment of the present invention similar to that shown in FIG. 4 and 5. The positioning of trough 60 is driven by a linear actuator 62. The piston 64 of linear actuator 62 has pivotally attached thereto an arm 66. Attached to the opposite end of arm 66 is shaft 68. Shaft 68 is supported for rotational movement by bearings 70. Bearings 70 arc supported by a frame (not shown). Affixed to shaft 68 are arms 72 which support trough 60. Linear actuator 62 drives rotation of shaft 68 to cause trough 60 to be moved in an arcuate path either into close proximity with the coating lip 74 of coating hopper 76 to thereby be in position to intercept the free-falling curtain, or away from coating lip 74 such that the free-falling curtain is not intercepted by trough 60. In such manner, trough 60 can be used prophylactically or as a corrective tool as described above with reference to trough 26 to establish a uniform wetting line on the back surface of coating lip 74.

Figure 8:
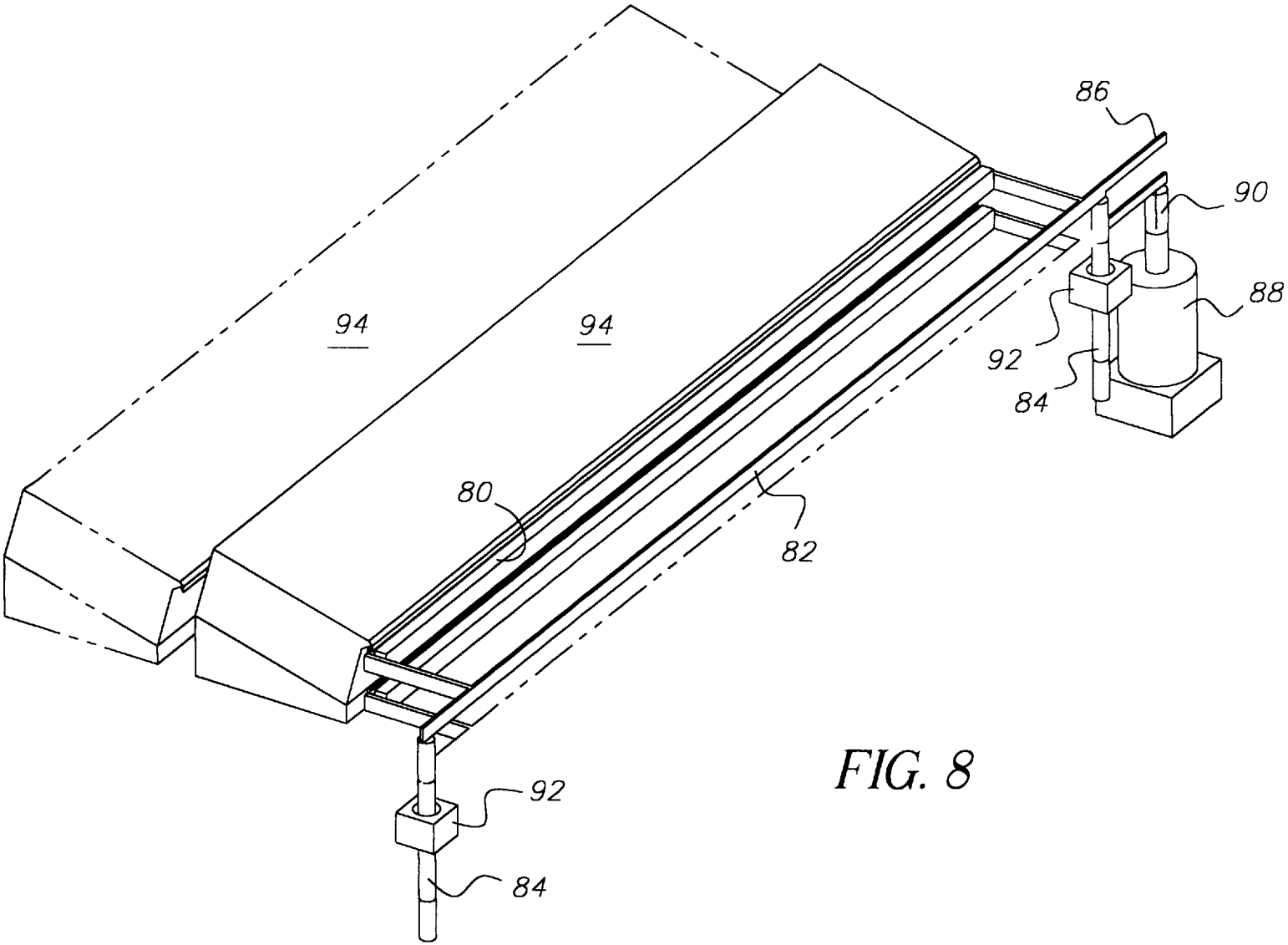
FIG. 8 is a perspective view of the movable trough of the present invention shown in combination with a curtain coating hopper wherein the movable trough is provided with a second alternative automated and powered positioning system from that depicted in FIGS. 4 and 5.
Figure 9:
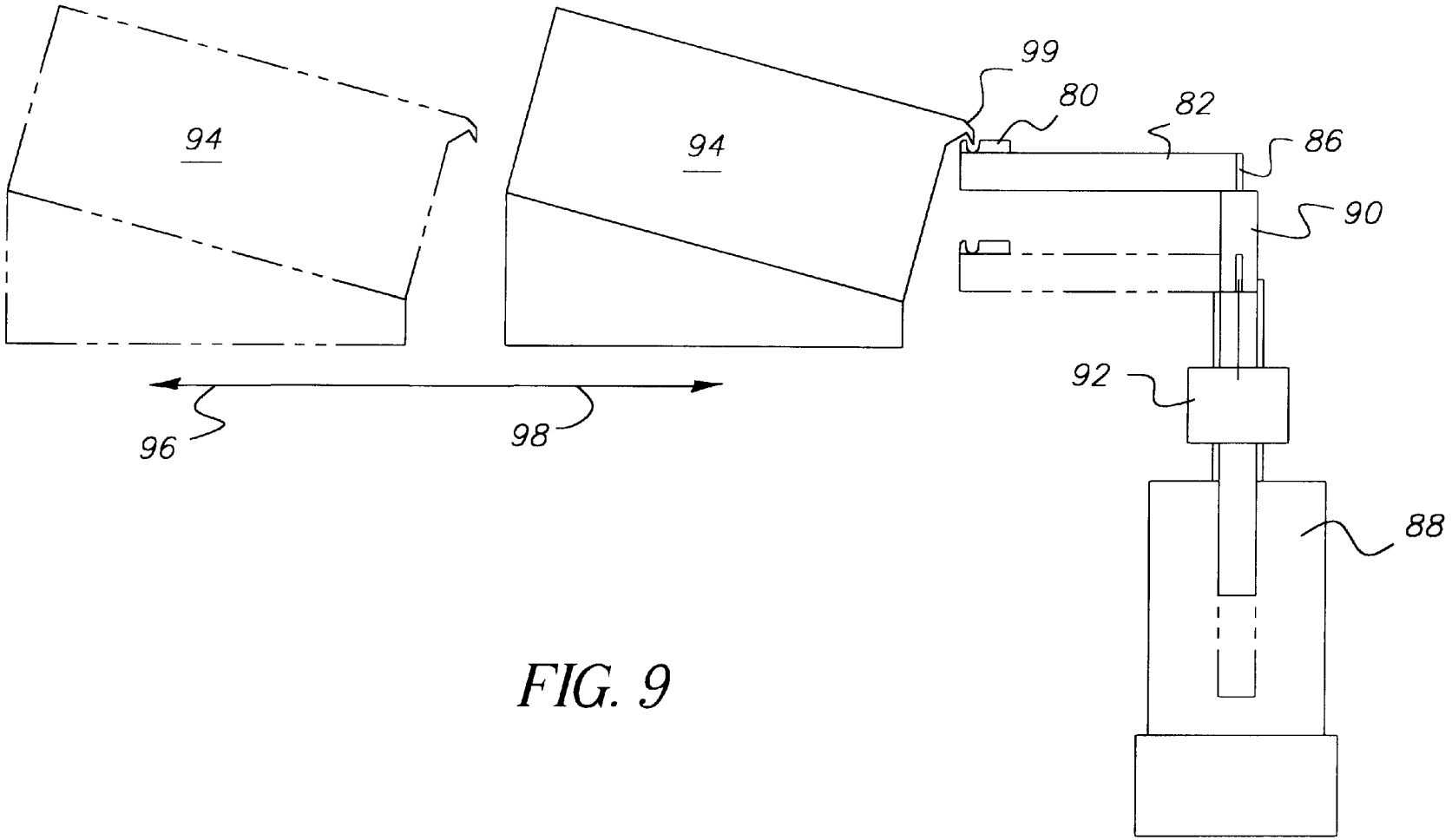
FIG. 9 is a side elevational schematic of the movable trough and system depicted in FIG. 8.

FIGS. 8 and 9 schematically depict yet another alternative embodiment for driving the movable trough of the present invention. The trough 80 (which is substantially identical to trough 26) is mounted on a support frame 82. Support frame 82 is in turn affixed to a pair of vertical guide bars 84. Support frame 82 includes a cantilevered section 86. A linear actuator 88 is provided wherein the piston 90 thereof engages a cantilevered section 86. In such manner, linear actuator 88 can raise and lower support frame 82 with vertical guide bars 84 sliding in bearings 92. Bearings 92 are supported by means not shown. It should be noted that the curtain coating hopper 94 moves between a coating position 96 in a preparation position 98. When the hopper 94 is in the coating position 96, the free falling curtain exiting lip 99 will impinge upon a moving web supported on a coating roller (not shown). Thus, in order to establish a uniform wetting line on the back surface of lip 99, the coating hopper 94 is moved into the preparation position 98. With the coating hopper 94 in the preparation position 98, linear actuator 88 is used to drive frame 82 vertically upward to thereby position trough 80 proximate to lip 99. In such manner, coating liquid or the startup liquid flowing over lip 99 floods the channel of trough 80 thereby establishing a wetting line on the back surface of lip 99 which is higher than the operating wetting line on the back surface of lip 99. Linear actuator 88 than lowers frame 82 and trough 80 away from lip 99. Then, with liquid still flowing from hopper 94 over lip 99, hopper 94 it is retracted to the operating position 96 and curtain coating of the moving web is begun.

Figure 10:
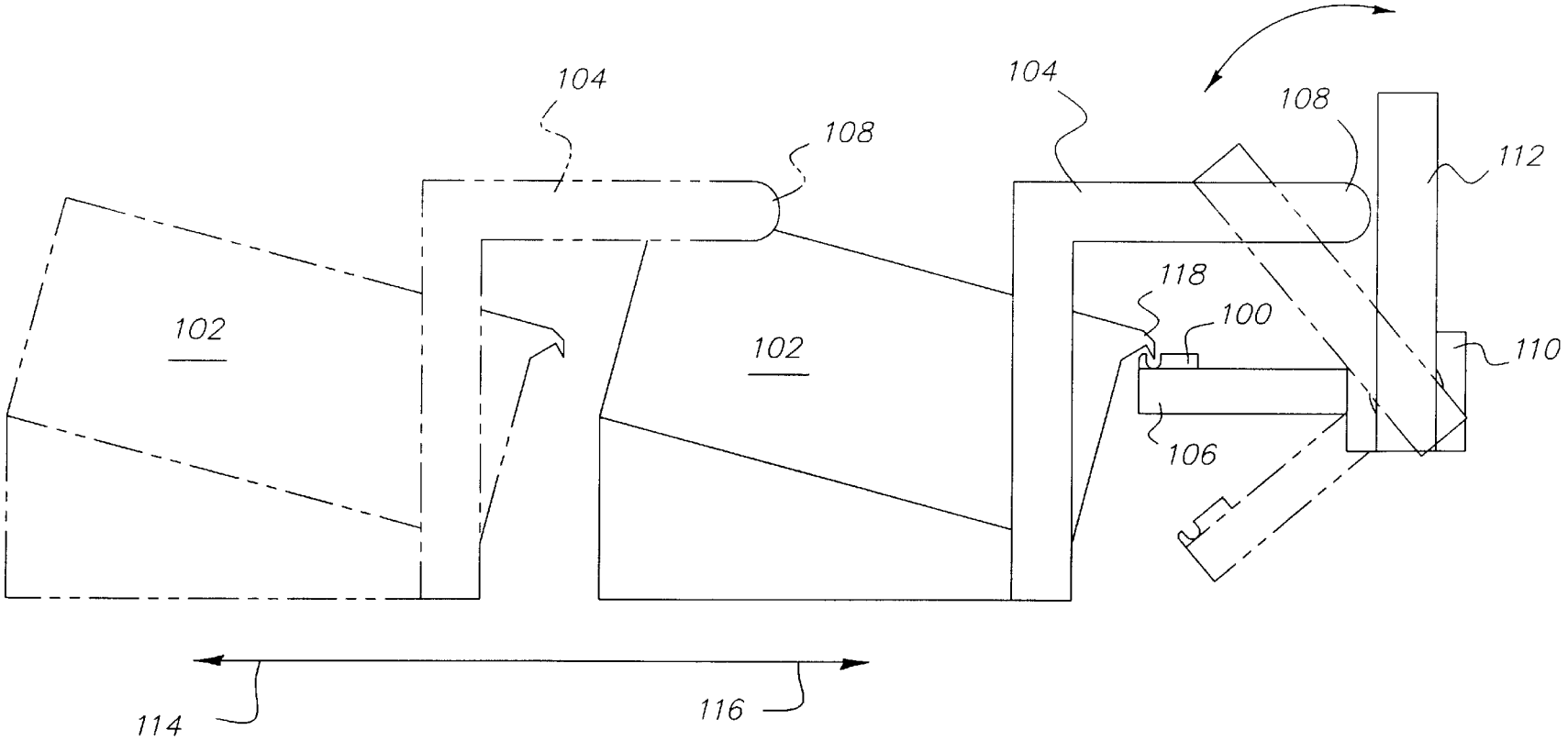
FIG. 10 is a side elevational schematic of the movable trough of the movable trough of the present invention shown in combination with a curtain coating hopper wherein the movable trough is provided with a third alternative automated and powered positioning system from that depicted in FIGS. 4 and 5.

Looking next at FIG. 10, still another alternative embodiment for driving the movement of the movable trough is depicted. In this embodiment the position of trough 100 is driven by the movement of the coating hopper 102. There is a bracket 104 mounted to the coating hopper 102. Bracket 104 includes a curved engaging surface 108. Trough 100 is mounted on beams 106 which extend from an axle not shown. The axle is rotatably supported in bearings 110 which are in turn supported by means not shown. Extending from each end of the axle are struts 112. In operation, when hopper 102 is moved from the operating position 114 to a preparation position 116 the curved engaging surfaces 108 of brackets 104 engage struts 112 for driving struts 112 to an upright position thereby causing beams 106 to be pivoted upwards. In such manner, trough 100 is raised to be positioned proximate to lip 118. Once the flow of liquid from lip 118 floods the channel in trough 100 thereby establishing a wetting line on the back surface of lip 118, hopper 102 is retracted to the operating position 114 so that coating of the moving web can be performed.

Figure 11:
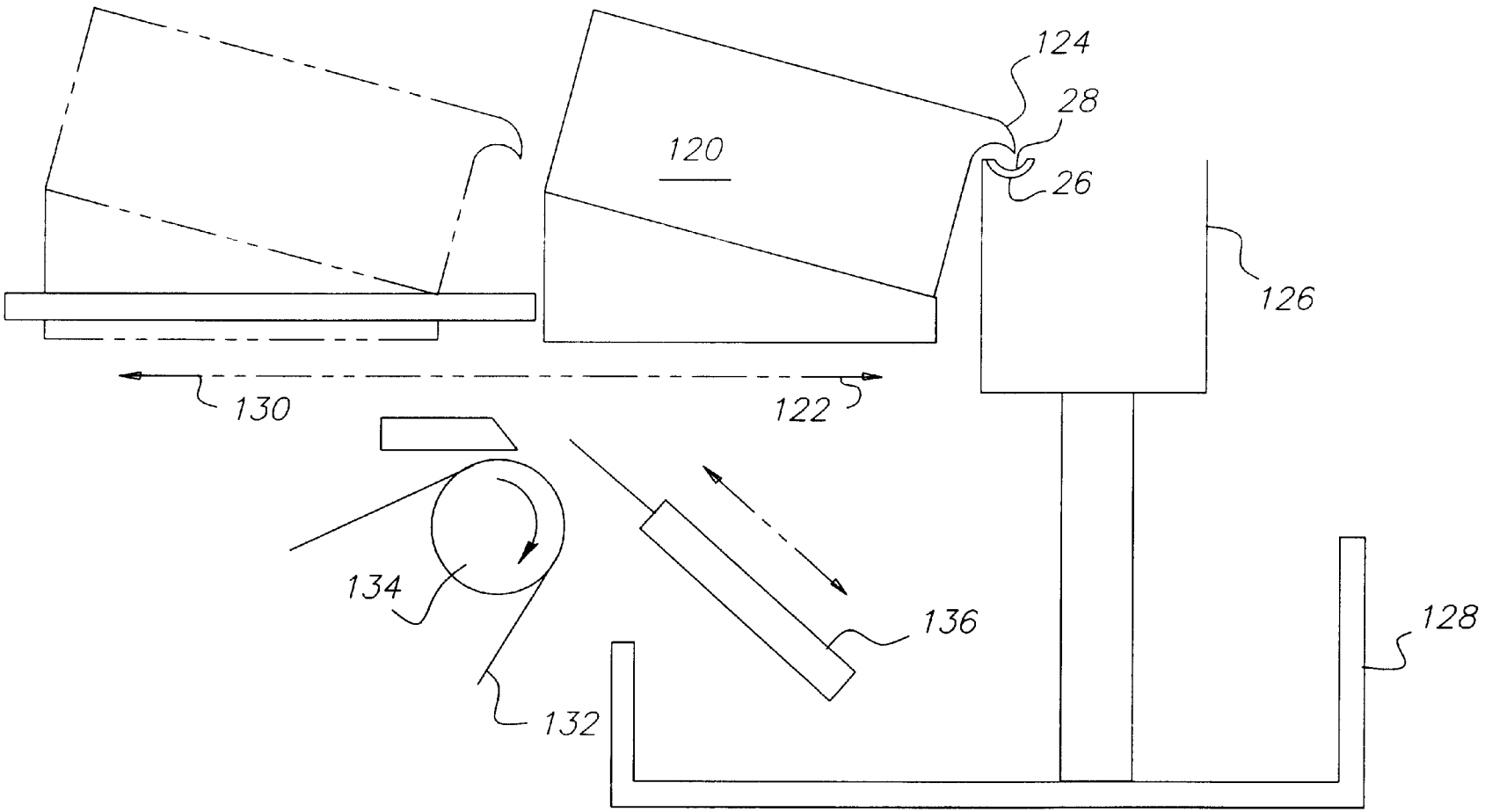
FIG. 11 is a schematic depicting a curtain coating system in combination with the movable trough of the present invention.

Generally, the movable trough 26, 40, 60, 80, 100 of the present invention is used when the coating hopper is in a preparation position as discussed above with reference to FIGS. 1 through 10. Looking at FIG. 11, there is schematically depicted a curtain coating system with the movable trough of the present invention 26, 40, 60, 80, 100. When the coating hopper 120 is in the preparation position 122, fluid flowing over the coating lip 124 will be collected in a preparation trough 126 or drain collection trough 128. Therefore, fluid exiting channel 28 at the ends thereof will also be captured in the preparation trough 126 or drain collection trough 128. Once a wetting line has been established on the back face of lip 124, the movable trough (26, 40, 60, 80, 100) is retracted, and the coating hopper 120 is retracted to an operating position 130. In the operating position, the coating lip 124 is positioned above a moving web 132, which is supported on a coating roll 134. The solution is captured by the start/finish pan 136 until the coating is ready to begin.

Those skilled in the art will recognize that, typically, coating hoppers in a curtain coating operation are used to coat the moving web with a composite layer. The composite layer is comprised of a plurality of superimposed individual layers. In the practice of the method of the present invention it is generally preferred to position the movable trough in close proximity to the lip prior to the introduction of the product solution. The trough is preferably not moved away from the lip until all product coating layers have been fully established through the coating hopper.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

PARTS LIST

1 finger
2 finger
3 frame
4 first surface
5 first surface
6 second or rear surface
7 second or rear surface
10 movable trough system
12 feet
14 adjustable legs
16 gussets
18 frame
20 pins
22 arcuate slot
24 pins
26 trough
27 hopper/coating lip
28 channel
29 curtain coating hopper
30 rear wall
31 front face
32 beveled surface
33 rear face
35 elevation
37 operating wetting line
40 trough
42 motor
44 drive shaft
46 bearings
48 arms
50 coating lip
52 coating hopper
60 trough
62 linear actuator
64 piston
66 arm
68 shaft
70 bearings
72 arms
74 coating lip
76 coating hopper
80 trough
82 support frame
84 vertical guide bars
86 cantilevered section
88 linear actuator
90 piston
92 bearings

94 curtain coating hopper
96 coating position
98 preparation position
99 exiting lip
100 trough
102 coating hopper
104 bracket
106 beams
108 curved engaging surface
110 bearings
112 struts
114 operation position
116 preparation position
118 coating lip
120 coating hopper
122 preparation position
124 coating lip
126 preparation trough
128 drain collection trough
130 operating position
132 moving web
134 coating roll
136 start/finish pan

What is claimed is:

1. A method for forming a uniform operating wetting line on a rear surface of a lip of a curtain coating hopper having a coating width comprising the steps of:

(a) moving a trough including a channel that is open at both ends thereof proximate to the lip to intercept a liquid flowing over the lip while maintaining the trough in a non-contacting relationship with the lip, the trough having a width between approximately 2 and 0.2 inches narrower than the coating width;

(b) flowing a liquid from the curtain coating hopper over the lip, the liquid filling the trough and flowing partially up the rear surface of the lip to wet the rear surface to an elevation which is higher than the uniform operating wetting line; and (c) moving the trough away from the lip to allow a liquid curtain to form and to establish the uniform operating wetting line.

2. A method as recited in claim 1 further comprising the step of:

allowing excess liquid flowing into the trough to flow out an opening at each end of the trough.

3. A method as recited in claim 1 further comprising the step of:

establishing all of the coating layers of a composite layer through the coating hopper prior to the step of moving the trough away from the lip.

4. A method as recited in claim 1 wherein:

the steps of moving the trough are performed to drive the trough along a linear path.

5. A method as recited in claim 1 wherein:

the steps of moving the trough are performed to drive the trough along an arcuate path.

6. An apparatus for forming a uniform wetting line along a coating width on a rear surface of a lip of a curtain coating hopper complising:

(a) a movable trough including a channel that is open at both ends thereof, the movable trough having a width between approximately 2 and 0.2 inches narrower than the coating width, and (b) means for supporting the movable trough proximate to the lip such that the channel aligns with the lip with the movable trough being in a non-contacting position with the lip, the rear surface being wetted to an elevation higher than an operating wetting line on the rear surface when a liquid is flowed from the curtain coating hopper over the lip thereby flooding the channel.

7. An apparatus as recited in claim 6 wherein:

the trough includes a front face with a beveled edge.

8. An apparatus for forming a uniform wetting line on a rear surface of lip of a curtain coating hopper having a coating width, the apparatus comprising:

(a) a trough including a channel that is open at both ends thereof, the trough having a width between approximately 2 and 0.2 inches narrower than the coating width; and (b) a frame for movably supporting the trough such that the trough is movable to a first position that is proximate to the lip and to a second position away from the lip, the channel aligning with the lip but spaced apart therefrom when the trough is in the first position, the channel flooding when a liquid is flowed from the curtain coating hopper over the lip and into the channel when the trough is in the first position thereby causing the rear surface of the lip to be simultaneously wetted to an elevation higher than an operating wetting line on the rear surface .

9. An apparatus as recited in claim 8 further comprising:

means for moving the trough between the first position and the second position such that when the trough is in the first position the liquid flowed from the coating hopper is simultaneously intercepted across the width thereof.

10. An apparatus as recited in claim 8 further comprising:

means for moving the trough in an arcuate path between the first position and the second position such that when the trough is in the first position the liquid flowed from the coating hopper is simultaneously intercepted across the width thereof.

11. An apparatus as recited in claim 8 further comprising:

means for moving the trough in a linear path between the first position and the second position such that when the trough is in the first position the liquid flowed from the coating hopper is simultaneously intercepted across the width thereof.

12. An apparatus as recited in claim 8 further comprising:

a motor for moving the trough in an arcuate path between the first position and the second position.

13. An apparatus as recited in claim 8 further comprising:

a linear actuator for moving the trough in an arcuate path between the first position and the second position.

14. An apparatus as recited in claim 8 further comprising:

a motor for moving the trough in a linear path between the first position and the second position.

15. An apparatus as recited in claim 8 further comprising:

a linear actuator for moving the trough in a linear path between the first position and the second position.

* * * * *